United States Patent [19]

Kumita et al.

[11] 4,184,057

[45] Jan. 15, 1980

[54] INERTIA SWITCH ASSEMBLY

[75] Inventors: Norio Kumita, Kariya; Seiichi Narita, Toyohashi, both of Japan

[73] Assignee: Nippondenso Co., Ltd., Kariya, Japan

[21] Appl. No.: 892,135

[22] Filed: Mar. 31, 1978

[30] Foreign Application Priority Data

Jun. 15, 1977 [JP] Japan ..... 52-71512

[51] Int. Cl.[2] ..... H01H 35/02

[52] U.S. Cl. ..... 200/61.45 R; 200/61.53

[58] Field of Search ..... 200/61.45 R, 61.5, 61.51, 200/61.52, 61.53; 340/668, 669

[56] References Cited

U.S. PATENT DOCUMENTS

| | | | |
|---|---|---|---|
| 1,845,848 | 2/1932 | Richards | 200/61.53 |
| 2,835,759 | 5/1958 | Waldow | 200/61.53 |
| 2,921,999 | 1/1960 | Ziegler, Jr. | 200/61.52 |
| 3,132,221 | 5/1964 | Kachline et al. | 200/61.53 |
| 3,735,072 | 5/1973 | Six, Jr. | 200/61.45 R |
| 3,957,363 | 5/1976 | Hayashi | 352/72 |
| 3,965,314 | 6/1976 | Sasaya et al. | 200/61.53 |
| 3,967,079 | 6/1976 | Sasaya et al. | 200/61.53 X |
| 4,097,699 | 6/1978 | Larson | 200/61.53 X |

*Primary Examiner*—James R. Scott

*Attorney, Agent, or Firm*—Cuhsman, Darby & Cushman

[57] ABSTRACT

In a housing having a cylindrical bore, an inertia sensing weight is slidably disposed. At one end of said weight, a movable contact is normally carried in complementary engagement thereby separating from a stationary contact.

When the weight moves under acceleration or deceleration, the movable contact accompanies the weight until the movable contact abuts the stationary contact. In the illustrated embodiment there is a second stationary contact normally separated from the first one. The movable contact, when closing, abuts both of them, making an electrical circuit therebetween.

11 Claims, 5 Drawing Figures

INERTIA SWITCH ASSEMBLY

BACKGROUND OF THE INVENTION

This invention relates to an improvement in a normally-open inertia sensing switch, especially for use in a vehicle safety system.

For example, the inertia sensing switch according to the present invention may be mounted in the vicinity of a vehicle bumber as a bumper sensor or on the vehicle floor as a floor sensor for use in a gas bag device.

SUMMARY OF THE INVENTION

It is a main object of the present invention to provide a more reliable normally-open inertia switch having a couple of contacts the contact pressure of which is irrespective of amount and frequency of acceleration or deceleration.

It is another object of the present invention to provide an improved, normally open inertia switch in which a movable contact is in complemental engagement with a weight, whereby when acceleration or deceleration is applied the weight and the movable contact move in a unit and when the movable contact meets a stationary contact, the weight leaves from the movable contact.

DESCRIPTION OF THE PREFERRED EMBODIMENT

Figure 1:
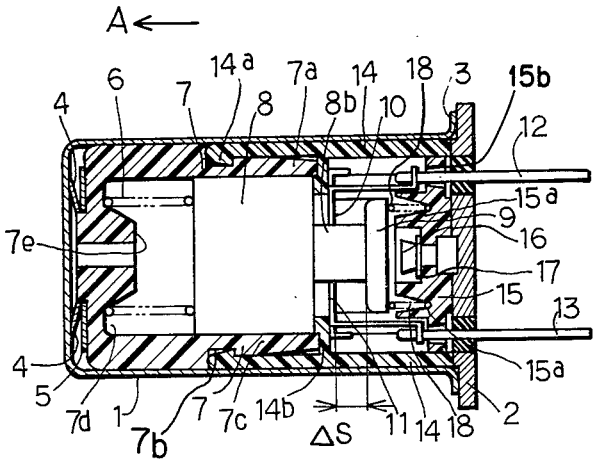
FIG. 1 is a longitudinal sectional view of the inertia switch according to the present invention.
Figure 2:
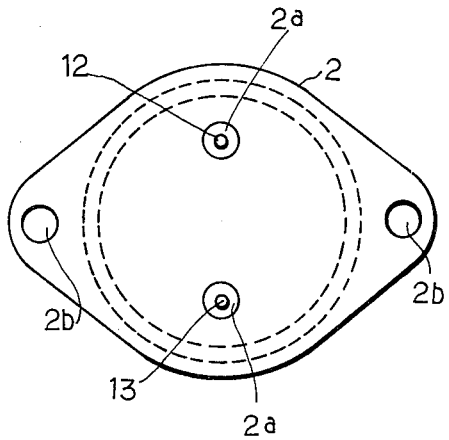
FIG. 2 is a side view of the embodiment shown in FIG. 1.

Referring now to FIGS. 1 through 4, a cup-shaped metal casing 1 is welded to a metal base plate 2 at the flange 3 of the casing 1 so that the inside of the casing 1 is hermetically sealed.

The base plate 2 has a couple of openings 2*a* through which lead wires extend and a couple of holes 2*b* for bolts by which the switch apparatus is secured to be installed. The openings 2*a* are filled with glass material to be sealed as well as to secure the lead wires to the base plate 2. At the bottom of the casing 1, a stainless saddle washer 4 and a flat washer 5 are disposed to resiliently support a cylinder member 7 made of polycarbonate glass. The cylinder member 7 has a cylinder bore therein in which a coil spring 6 is disposed to urge a cylindrical weight member 8, which is slidably disposed therein.

Figure 3:
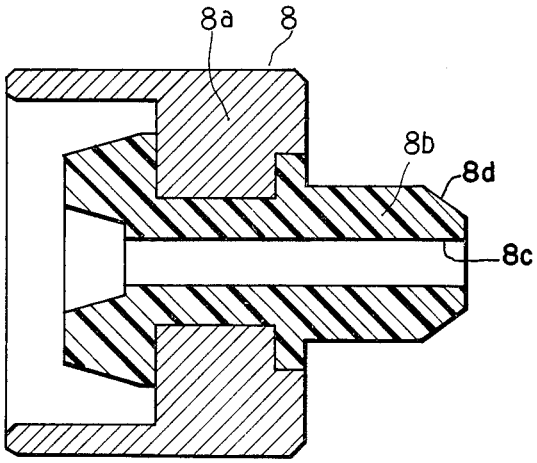
FIG. 3 is an enlarged longitudinal sectional view of a weight used in the embodiment shown in FIG. 1.

The cylinder member 7 further has an annular groove on the outer surface thereof, a tapered open end 7*c*, an annular groove 7*d* at the bottom portion in which the coil spring 6 is retained and a stopper portion 7*e*. The coil spring 6 is arranged to yield when the weight member 8 moves under deceleration or acceleration which exceeds a predetermined amount. As shown in FIG. 3, the weight member 8 comprises a brass mass body 8*a* and a cylindrical projecting portion 8*b* made of insulating material which has a center bore 8*c* and a tapered end 8*d*.

Figure 4:
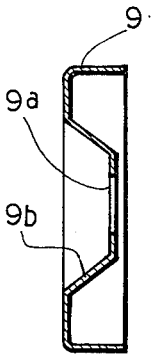
FIG. 4 is an enlarged sectional view of a movable contact used in the embodiment shown in FIG. 1.

As shown in FIG. 4, a cup-shaped movable contact 9 has a tapered concave end surface 9*b* having an annular flaring portion which is in complementary contact with the tapered end 8*d* of the projecting portion 8*b*. The movable contact 9 has a center opening 9*a*, whereby the air in the cylindrical casing is free to move from one side of the weight member 8 to the other side through the center bore of the projecting portion 8*b* and the opening 9*a*. The movable contact 9 is preferably made of brass plated with gold thereon. A cylindrical spacer 14 made of polycarbonate is disposed between the cylinder member 7 and the base plate 2 in the casing 1. The spacer 14 has an annular claw 14*a* at its one end which engages with the annular groove 7*b* and a ledge 14*b* one side of which abuts the tapered end of the cylinder member 7 to retain same. The ledge 14*b* also provides a stopper for restricting the weight member 8. On the other side of the ledge 14*b*, a couple of stationary contacts 10 and 11 are supported. The contacts 10 and 11 are respectively soldered to lead wires 12 and 13. A spring retainer 15 made of polycarbonate is secured to the base plate 2 by a rivet 16 and a flat washer 17 at the center thereof. The retainer 15 has an annular groove 15*a* in which a coil spring 18 is retained to urge the movable contact against the weight member and a couple of openings 15*b* through which the lead wires 12 and 13 extend. The spring force of the coil spring is arranged to have a proper contact pressure when the movable contact 9 comes into bridging contact with the stationary contacts 10 and 11.

In operation, when extraordinary acceleration is applied to the weight member 8 in the direction shown by arrow A in FIG. 1 due to, for instance, vehicle collision, the weight member 8 and the movable contact 9 in unit move from the state shown in FIG. 1 to the left until the movable contact 9 abuts the stationary contacts 10 and 11 to close an electric circuit. It is noted that since the weight member 8 slides on the inner surface of the cylinder member 7, the movable contact 9 in complementary engagement with the member 8 also moves in a straight line so that the switching operation of the stationary and movable contacts is very smooth. Thereafter, the weight member keeps moving until it abuts the stopper portion 7*d* of the cylinder member 7. It is noted that the contacting pressure of the stationary and movable contacts is not affected by the weight member 8 and that since the weight member 8 moves away from the movable contact 9 thereafter, contact chattering otherwise caused by rebound of the weight member 8 is completely eliminated, ensuring a sufficient contact closing time.

Through experiments, it has been found that the inertia switch used for the floor sensor is required to close the contacts (generally referred to as sensing time) within 20 milliseconds (ms) after the vehicle collision at 30 miles per hour (M/s) and to hold the closing state for more than 5 ms (generally referred to as hold time).

Figure 5:
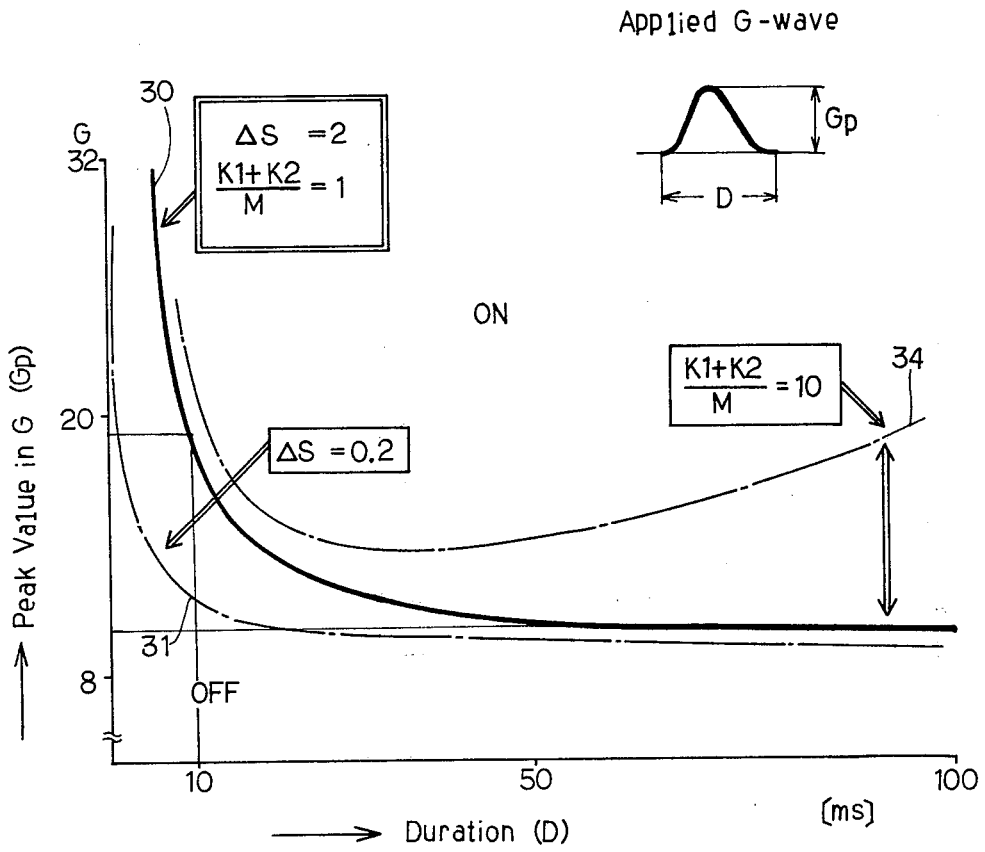
FIG. 5 is a graph showing various operating characteristics of the inertia switches having various parameters according to the present invention

FIG. 5 shows contact closing characteristic curves when an acceleration wave (G wave) having a peak of acceleration having a gravity value (G-value) and having a duration D in milliseconds is applied.

When the original distance $\Delta S$ between the movable and stationary contacts is 2 millimeters (mm) and spring to mass ratio $(K_1+K_2)/M$ is 1 $[mm^{-1}]$, where $K_1$, $K_2$ and M are spring constants in [g/mm] of the coil springs 6 and 18 and weight in grams of the weight member 8, then the curve designated by numeral 30 indicates that the switch cannot close the contacts within ten milliseconds if the G-wave applied thereto is no greater than 19G. If ΔS is decreased to 0.2, the switch may close under the acceleration less than 10G. If the ratio $(K_1+K_2)/M$ is increased to 10 with ΔS being 2, the switch will operates as shown by curve 34. In view of the above, it has been found necessary that the distance between the contact ΔS is larger than 0.5 mm in order for the switch to perform properly without affection of high frequency noises and that the spring-mass ratio $(K_1+K_2)/M$ is smaller than 4 [$mm^{-1}$] in order to stabilize switching performance in the low frequency area (having long duration). A test for evaluating the weight members respectively weighting 4.5, 5.5 and 6.5 grams has shown that the heavier the weight member, the longer the hold time of the contacts. Another test on the contact spring 18 was conducted as to the initial spring loads, respectively, of 10, 30 and 50 grams and it was found that the less the load the longer the hold time. It was found, further, that the cup-shaped movable contact 9 should be less than 0.2 gram in order to have the sufficient hold time and the proper sensing time.

What is claimed is:

1. An inertia switch apparatus comprising:

a housing, a stationary contact means disposed in and secured to said housing, a movable contact normally disposed at a distance from said stationary contact in said housing so as to make contact with said stationary contact means in a predetermined manner, a weight member slidably disposed in said housing and having one end normally in contact with said movable contact, said weight member and said movable contact being normally in complementary engagement, a first spring, disposed between the other end of said weight member and said housing, for urging said weight member against said movable contact to normally separate said movable contact from said stationary contact means, and a second spring, disposed between said movable contact and said housing, for urging said movable contact against said weight member so as to close said movable contact to said stationary contact means when said weight member is separated from said movable contact.

2. An inertia switch apparatus according to claim 1, wherein said weight member has a projecting portion having a free end, and said movable contact has an axially-presented concave end surface with which the free end of said projecting portion is normally in contact.

3. An inertia switch apparatus according to claim 2, wherein said projecting portion is made of insulating material.

4. An inertia switch apparatus according to claim 3, wherein said projecting portion free end tapers toward said movable contact and said movable contact concave end surface with which the tapered free end of said projecting portion normally is in contact complementarily includes a portion which flares toward said projecting portion free end, said tapered free end normally facially engaging said concave end surface flaring portion.

5. An inertia switch apparatus comprising a tubular case, a cylinder member disposed in said tubular member and having a cylindrical bore, a base member to which the open end of said tubular member is secured said base member having a compartment in communication with the cylindrical bore, of said cylinder member, a stationary contact means disposed in and secured to said base member, a movable contact disposed at a distance from said stationary contact in said base member so as to make and break contact with said stationary contact means, a weight member slidably disposed in the cylindrical bore of said cylinder member and having one end in separatable contact with said movable contact, said weight member and said movable contact normally being in complementary engagement, a first spring, disposed in the cylindrical bore of said cylinder member, for urging said weight member against said movable contact to separate said movable contact from said stationary contact means, said first spring being arranged to yield when a predetermined force is applied thereto by said weight member, and a second spring, disposed in the compartment of said base member, for urging said movable contact against said weight member so as to close said movable contact to said stationary contact means when said weight member moves against said first spring.

6. An inertia switch apparatus according to claim 5, wherein said weight member has a tapered projecting portion of insulating material and said movable contact has a flaring concave surface with which the tapered projecting portion normally abuts.

7. An inertia switch apparatus according to claim 1 or 5, wherein the spring-mass ratio $(K_1+K_2)/M$ is smaller than 4, wherein $K_1$: spring constant of said first spring in (g/mm)

$K_2$: spring constant of said second spring in (g/mm)

M: weight of said weight member in (g).

8. An inertia switch apparatus according to claim 1 or 5, wherein the weight of said weight member is more than 6.5 grams.

9. An inertia switch apparatus according to claim 1 or 5, wherein said movable contact is lighter than 0.2 gram.

10. An inertia switch apparatus according to claim 1, wherein:

the stationary contact means is constituted by first and second normally separated stationary contacts, and said movable contact, when making contact with said stationary contact means electrically bridges between said first and second stationary contacts.

11. An inertia switch apparatus according to claim 5, wherein the stationary contact means is constituted by first and second normally separated stationary contacts, and said movable contact, when making contact with said stationary contact means electrically bridges between said first and second stationary contacts.

* * * * *